US005903524A

United States Patent [19]

Clarke

[11] Patent Number: 5,903,524

[45] Date of Patent: May 11, 1999

[54] PERSONAL MENSTRUAL CYCLE CLOCK

[76] Inventor: Claude C. Clarke, c/o C.Albarus, 17 Fort George Hill, Apt. 14C, New York, N.Y. 10040

[21] Appl. No.: 08/825,907

[22] Filed: Apr. 2, 1997

[51] Int. Cl.[6] ..... G04F 8/00

[52] U.S. Cl. ..... 368/240; 368/28; 368/107

[58] Field of Search ..... 368/240–242, 368/223, 239, 107, 28

[56] References Cited

U.S. PATENT DOCUMENTS

| | | | |
|---|---|---|---|
| 4,041,692 | 8/1977 | Marshino | 368/82 |
| 4,920,524 | 4/1990 | Kotob | 368/240 |

FOREIGN PATENT DOCUMENTS

| | | | |
|---|---|---|---|
| 5451 | 3/1993 | European Pat. Off. | 368/240 |
| 2204429 | 11/1988 | United Kingdom | 368/240 |

*Primary Examiner*—Bernard Roskoski

*Attorney, Agent, or Firm*—Richard L. Miller, P.E.

[57] ABSTRACT

A personal menstrual cycle clock that indicates a safe time to indulge in sexual intercourse. The clock includes a housing, a plurality of bulbs, and illuminating apparatus. The housing has a top with a transparent ring therearound that is divided into 28 sections, each of which representing a day of the menstrual cycle. Each bulb of the plurality of bulbs consecutively illuminates through a respective section of the 28 sections of the transparent ring. And, the illuminating apparatus consecutively illuminates the plurality of bulbs by use of a ring counter that is in electrical communication with a clock which generates a pulse each time the clock indicates 12:00 AM with the pulse consecutively activating the counters of the ring counter and progressively illuminating and extinguishing each bulb of the plurality of bulbs with the first 10 and last 11 bulbs being green to indicate a safe time to indulge in sexual intercourse and with the eleventh through seventeenth bulbs being blinking red to indicate an unsafe time to indulge in sexual intercourse.

6 Claims, 2 Drawing Sheets

PERSONAL MENSTRUAL CYCLE CLOCK

BACKGROUND OF THE INVENTION

1. Field of the Invention

The present invention relates to a menstrual calendar. More particularly, the present invention relates to a personal menstrual cycle clock that aids couples practicing a rhythmic abstinence method of birth control as well as for those wishing to become pregnant.

2. Description of the Prior Art

It is well known that a female is susceptible to impregnation during only a portion of her menstrual cycle. Specifically, the normal female is capable of being impregnated by sexual intercourse only when such intercourse occurs during that portion of the menstrual cycle that is near in time to ovulation.

Numerous innovations for menstrual calendars have been provided in the prior art that will be described. Even though these innovations may be suitable for the specific individual purposes to which they address, however, they differ from the present invention.

FOR EXAMPLE, U.S. Pat. No. Des. 261,275 to Christensen teaches the ornamental appearance for a disk for a menstrual calendar.

ANOTHER EXAMPLE, U.S. Pat. No. 3,964,674 to Van der Gaast teaches a menstrual calculator that determines the fertile dates of a period composed of a base panel and dials and a pointer which bear date indicia and are rotatable independently about a common dial pin.

STILL ANOTHER EXAMPLE, U.S. Pat. No. 4,350,878 to Schwarz et al. teaches a calculating device to aid in predicting the periods of fertility and non-fertility during a menstrual cycle of a user. The device includes a first disc having indicia thereon representing the calendar days of the present month and the next month, a second disc having indicia thereon indicating the length of and the days in a normal menstrual cycle of the user, and a base plate having markers thereon which, when placed in proper registry with the indicia on the two disc, indicate which calendar days during the present menstrual cycle the user is fertile. In a second embodiment an additional disc is provided for indicating days in the shortest period of a user who has irregular menstrual cycles. This additional disc, when placed in registry with the other discs indicates an expanded period of fertility for the user.

YET ANOTHER EXAMPLE, U.S. Pat. No. 4,752,674 to Rosenwaks teaches a calculator used for displaying menstrual cycle synchronization of donors and recipients during embryo transfer procedures that includes first, second and third members aligned with one another. In accordance with a preferred embodiment, the first member is a disc having the days of the menstrual cycle of the recipient thereon. The second member is a disc having dates of the monthly calendar thereon, and the third member is a disc having the days of the donor's menstrual cycle thereon. By aligning a window in the third disc with the seventeenth through nineteenth day of the recipient's menstrual cycle as displayed on the first disc, the days of the donor's cycle are substantially fixed. By then aligning the monthly dates on the second disc with the corresponding day on either the first or second disc, one may determine either when the recipient's cycle must start to synchronize with donor egg development or when the donor's egg must be stimulated in order to be available for transfer to the recipient when the recipient is most receptive to a successful transfer.

STILL YET ANOTHER EXAMPLE, U.S. Pat. No. 4,527,906 to Jezbera teaches a digital menstrual cycle indicator for indicating the fertile portion of a woman's menstrual cycle. A standard watch module that can be continuously operated in a certain adjust mode, has a multi-digit display and a clock pulse source, so the module serves as an inexpensive display and clock pulse source. A divider circuit is used to divide the output of the clock pulse source and increment the multi-digit display by "1" once each twenty-four hours, after the module has been forced into the adjust mode. A hidden switch is used to force the module into the adjust mode, clear the divider and clear the display. Fail-safe circuits are included to prevent the erroneous display of data due to a weak battery or an interruption of the power or ground buses.

FINALLY, YET STILL ANOTHER EXAMPLE, U.S. Pat. No. 5,058,084 to Riesen teaches a device for planning the sex of a child according to the time selection method exhibits differently marked display sections, relative to a display starting position, for labeling the days of fertility and the days of infertility in a cycle and a limited cycle variation range. Within the display section for the days of fertility, clearly distinguishably marked day position fields are provided which, for cycle lengths of 27 to 30 days, serve as an indication of the days of probability for conceiving a boy or a girl. The counting and display of the days of probability by the cycle pointer occurs from the respective first days of a new menstruation. Correspondingly, the display element can be adjusted to the starting point.

It is apparent that numerous innovations for menstrual calendars have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a personal menstrual cycle clock that avoids the disadvantages of the prior art.

ANOTHER OBJECT of the present invention is to provide a personal menstrual cycle clock that is simple and inexpensive to manufacture.

STILL ANOTHER OBJECT of the present invention is to provide a personal menstrual cycle clock that is simple to use.

BRIEFLY STATED, YET ANOTHER OBJECT of the present invention is to provide a personal menstrual cycle clock that indicates a safe time to indulge in sexual intercourse. The clock includes a housing, a plurality of bulbs, and illuminating apparatus. The housing has a top with a transparent ring therearound that is divided into 28 sections, each of which representing a day of the menstrual cycle. Each bulb of the plurality of bulbs consecutively illuminates through a respective section of the 28 sections of the transparent ring. And, the illuminating apparatus consecutively illuminates the plurality of bulbs by use of a ring counter that is in electrical communication with a clock which generates a pulse each time the clock indicates 12:00 AM with the pulse consecutively activating the counters of the ring counter and progressively illuminating and extinguishing each bulb of the plurality of bulbs with the first 10 and last 11 bulbs being green to indicate a safe time to indulge in sexual intercourse and with the eleventh through seventeenth bulbs being blinking red to indicate an unsafe time to indulge in sexual intercourse.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
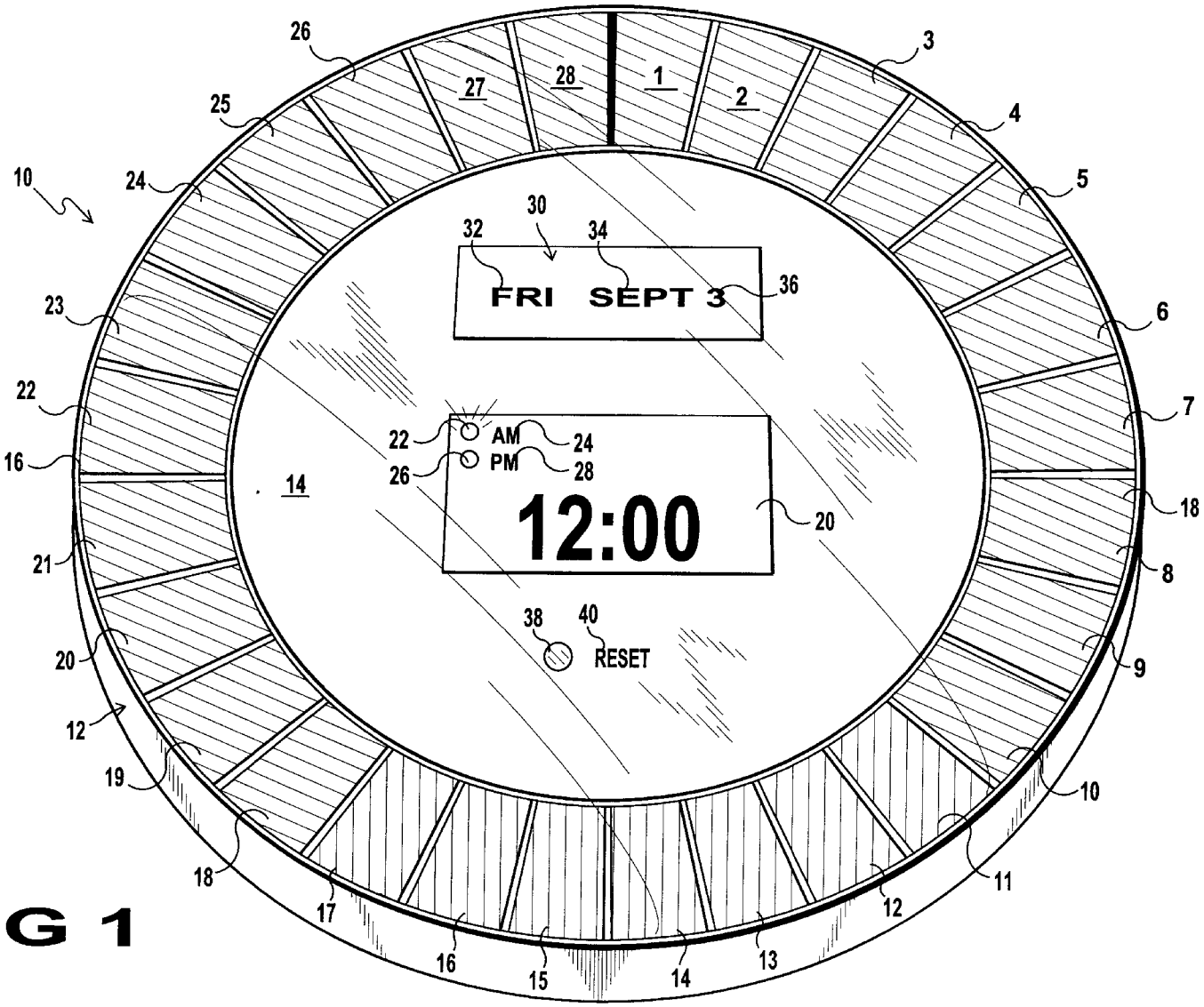
FIG. 1 is a diagrammatic perspective view of the present invention.

10 personal menstrual cycle clock of the present invention
12 housing
14 housing top
16 housing top periphery
18 ring
20 digital clock
22 clock AM indicator light
24 clock AM indicator light AM indica
26 clock PM indicator light
28 clock PM indicator light PM indica
30 digital calendar
32 calendar day of the week
34 calendar month
36 calendar day
38 reset switch
40 reset switch RESET indicia
42 power source
44 ring counter
45 ground
46 28 relays
48 first set of 10 green bulbs
50 7 blinking red bulbs
52 second set of 11 green bulbs

DETAILED DESCRIPTION OF THE PREFERRED EMBODIMENT

Referring now to the figures in which like numerals indicate like parts, and particularly to FIG. 1, the personal menstrual cycle clock of the present invention is shown generally at 10.

The personal menstrual cycle clock 10 includes a housing 12 that is thin and cylindrically-shaped and has a housing top 14 that is circular-shaped with a housing top periphery 16 and a center.

The personal menstrual cycle clock 10 further includes a ring 18 that is translucent and disposed at, and concentric with, the housing top periphery 16 of the housing top 14 of the housing 12. The ring 18 is divided into 28 equally-spaced sections with the numbers 1–28 disposed consecutively thereon and representing each day of the menstrual cycle.

The personal menstrual cycle clock 10 further includes a digital clock 20 that is disposed at the center of the housing top 14 of the housing 12 and has a clock AM indicator light 22 with clock AM indicator light AM indica 24 disposed next thereto and a clock PM indicator light 26 with clock PM indicator light PM indica 28 disposed next thereto.

The personal menstrual cycle clock 10 further includes a digital calendar 30 that is disposed on the housing top 14 of the housing 12, between the digital clock 20 and the ring 18, and indicates the calendar day of the week 32, the calendar month 34, and the calendar day 36.

The personal menstrual cycle clock 10 further includes a reset switch 38 that is disposed on the housing top 14 of the housing 12, between the digital clock 20 and the ring 18, diametrically opposite to the digital calendar 30, and has reset switch RESET indicia 40 disposed next thereto.

Figure 2:
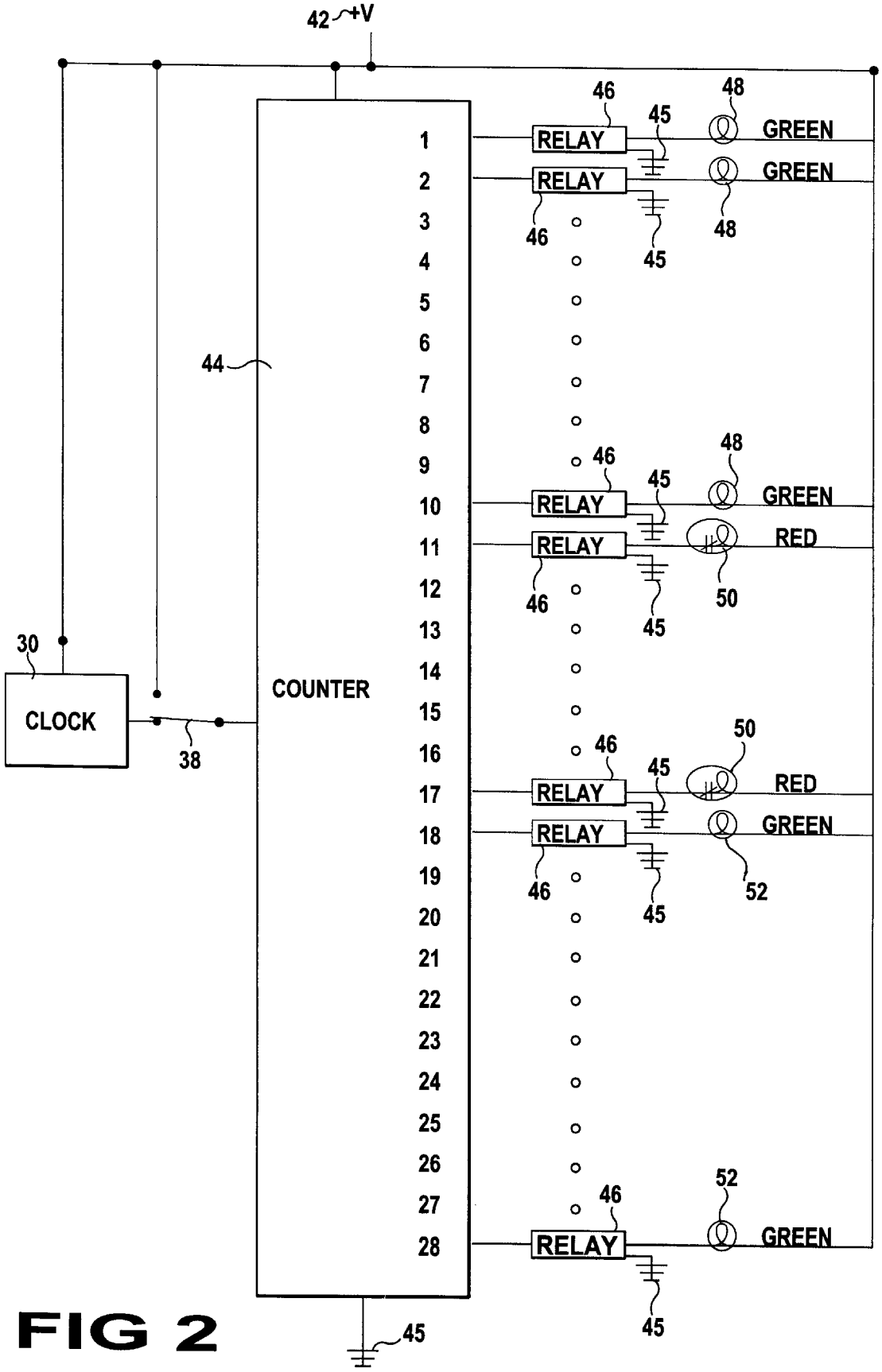
FIG. 2 is a block diagram of the present invention.

As shown in FIG. 2, the digital clock 20 is in electrical communication with a power source 42 and with the reset switch 38 which also is in electrical communication with the power source 42. The power source 42 is preferably replaceable batteries contained within the housing 12.

The personal menstrual cycle clock 10 further includes a ring counter 44 that is contained within the housing 12 and is in electrical communication with the reset switch 38, the power source 42, and ground 45. The ring counter 44 has 28 counter positions thereto, each of which being associated with a respective section of the 28 equally-spaced sections of the ring 28.

The personal menstrual cycle clock 10 further includes 28 relays 46 that are contained within the housing 12. Each relay of the 28 relays 46 is in electrical communication with the ground 45 and with a respective counter position of the 28 counter positions of the ring counter 44.

It is to be understood that the 28 relays 46 are representative of any lamp driving device and can be integrally combined with the ring counter 44.

The personal menstrual cycle clock 10 further includes a first set of 10 green bulbs 48 that are contained within the housing 12. Each green bulb of the first set of 10 green bulbs 48 selectively illuminates a respective section of the first 10 sections of the 28 equally-spaced sections of the ring 18. Each green bulb of the first set of 10 green bulbs 48 is in electrical communication with the power source 42 and with a respective relay of the 28 relays 46 that are in electrical communication with the first ten counter positions of the 28 counter positions of the ring counter 44.

The personal menstrual cycle clock 10 further includes 7 blinking red bulbs 50 that are contained within the housing 12. Each blinking red bulb of the 7 blinking red bulbs 50 selectively illuminates a respective section of the next 7 sections of the 28 equally-spaced sections of the ring 18. Each blinking red bulb of the 7 blinking red bulbs 50 is in electrical communication with the power source 42 and with a respective relay of the 28 relays 46 that are in electrical communication with the next 7 counter positions of the 28 counter positions of the ring counter 44.

The personal menstrual cycle clock 10 further includes a second set of 11 green bulbs 52 that are contained within the housing 12. Each green bulb of the second set of 11 green bulbs 52 selectively illuminates a respective section of the next and final 11 sections of the 28 equally-spaced sections of the ring 18. Each green bulb of the second set of 11 green bulbs 52 is in electrical communication with the power source 42 and with a respective relay of the 28 relays 46 that are in electrical communication with the next and final 11 counter positions of the 28 counter positions of the ring counter 44.

In operation, at the first day of the menstrual cycle the reset switch 38 is closed causing the ring counter 44 to initialize. This initialization activates the first counter position of the 28 counter positions of the ring counter 44 which in turn closes the first relay of the 28 relays 46 that is in electrical communication therewith. In turn the closed first relay of the 28 relays 46 causes the first green bulb of the first set of 10 green bulbs 48 that is in electrical communication therewith to illuminate and cause the first section of the 28 equally-spaced sections of the ring 18 to illuminate and indicate the first day of the menstrual cycle.

Each time the digital clock 30 indicates 12:00 AM, it generates a pulse to the ring counter 44 which causes the ring counter 44 to activate a next subsequent counter position of the 28 counter positions of the ring counter 44 and deactivate a next previous counter position of the 28 counter positions of the ring counter 44 and thereby extinguishing a next previous green bulb of the first set of 10 green bulbs 48. This activated next subsequent counter position of the 28 counter positions of the ring counter 44 closes a next subsequent relay of the 28 relays 46 that is in electrical communication therewith. In turn the closed next subsequent relay of the 28 relays 46 causes a next subsequent green bulb of the first set of 10 green bulbs 48 that is in electrical communication therewith to illuminate and cause a next subsequent section of the 28 equally-spaced sections of the ring 18 to illuminate and indicate consecutively the second through tenth days of the menstrual cycle.

The first 10 days of the menstrual cycle utilizes green bulbs to indicate a safe time to indulge in sexual intercourse with minimal chance of pregnancy.

After the last green bulb of the first set of 10 green bulbs 48 has been illuminated, and the digital clock 30 again indicates 12:00 AM, it generates a pulse to the ring counter 44 which causes the ring counter 44 to activate the eleventh counter position of the 28 counter positions of the ring counter 44 and deactivate the tenth counter position of the 28 counter positions of the ring counter 44 and thereby extinguish the tenth and final green bulb of the first set of 10 green bulbs 48. This activated eleventh counter position of the 28 counter positions of the ring counter 44 closes the eleventh relay of the 28 relays 46 that is in electrical communication therewith. In turn the closed eleventh relay of the 28 relays 46 causes a first blinking red bulb of the 7 blinking red bulbs 50 that is in electrical communication therewith to blink which in turn causes the eleventh section of the 28 equally-spaced sections of the ring 18 to blink and indicate the 11 day of the menstrual cycle.

Each time the digital clock 30 again indicates 12:00 AM, it generates a pulse to the ring counter 44 which causes the ring counter 44 to activate a next subsequent counter position of the 28 counter positions of the ring counter 44 and deactivate a next previous counter position of the 28 counter positions of the ring counter 44 and thereby extinguish a next previous blinking bulb of the 7 blinking red bulbs 52. This activated next subsequent counter position of the 28 counter positions of the ring counter 44 closes a next subsequent relay of the 28 relays 46 that is in electrical communication therewith. In turn the closed next subsequent relay of the 28 relays 46 causes a next subsequent blinking red bulb of the 7 blinking red bulbs 50 that is in electrical communication therewith to blink and cause a next subsequent section of the 28 equally-spaced sections of the ring 18 to blink and indicate consecutively the twelfth through seventeenth days of the menstrual cycle.

The eleventh through seventeenth days of the menstrual cycle utilizes red bulbs to indicate an unsafe time to indulge in sexual intercourse with maximum chance of pregnancy, especially during the twelfth through sixteenth days when ovulation occurs.

After the last blinking red bulb of the 7 blinking red bulbs 50 has been illuminated, and the digital clock 30 again indicates 12:00 AM, it generates a pulse to the ring counter 44 which causes the ring counter 44 to activate the eighteenth counter position of the 28 counter positions of the ring counter 44 and deactivate the seventeenth counter position of the 28 counter positions of the ring counter 44 and thereby extinguish the seventeenth and final blinking red bulb of the 7 blinking red bulbs 50. This activated eighteenth counter position of the 28 counter positions of the ring counter 44 closes the eighteenth relay of the 28 relays 46 that is in electrical communication therewith. In turn the closed eighteenth relay of the 28 relays 46 causes a first green bulb of the second set of 11 green bulbs 52 that is in electrical communication therewith to illuminate which in turn causes the eighteenth section of the 28 equally-spaced sections of the ring 18 to illuminate and indicate the eighteenth day of the menstrual cycle.

Each time the digital clock 30 again indicates 12:00 AM, it generates a pulse to the ring counter 44 which causes the ring counter 44 to activate a next subsequent counter position of the 28 counter positions of the ring counter 44 and deactivate a next previous counter position of the 28 counter positions of the ring counter 44 and thereby extinguish a next previous green bulb of the second set of 11 green bulbs 52. This activated next subsequent counter position of the 28 counter positions of the ring counter 44 closes a next subsequent relay of the 28 relays 46 that is in electrical communication therewith. In turn the closed next subsequent relay of the 28 relays 46 causes a next subsequent green bulb of the second set of 11 green bulbs 52 that is in electrical communication therewith to illuminate and cause a next subsequent section of the 28 equally-spaced sections of the ring 18 to illuminate and indicate consecutively the nineteenth through twenty eighth days of the menstrual cycle.

The eighteenth through twenty eight days of the menstrual cycle utilizes green bulbs to indicate a safe time to indulge in sexual intercourse with minimal chance of pregnancy.

It will be understood that each of the elements described above, or two or more together, may also find a useful application in other types of constructions differing from the types described above.

While the invention has been illustrated and described as embodied in a personal menstrual cycle clock, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A personal menstrual cycle clock, comprising:

a) a housing having a top being circular-shaped with a periphery and a center;

b) a plurality of bulbs consecutively illuminating through said top of said housing; said plurality of bulbs having a portion thereof being blinking bulbs;

c) means for consecutively illuminating said plurality of bulbs; said means including a digital clock disposed at said center of said top of said housing; said digital clock having an AM indicator light with AM indica disposed next thereto and a PM indicator light with PM indica disposed next thereto;

d) a ring being translucent and disposed at, and concentric with, said periphery of said top of said housing; said ring being divided into 28 equally-spaced sections with numbers 1–28 disposed consecutively thereon representing each day of a menstrual cycle; and e) a digital calendar disposed on said top of said housing, between said digital clock and said ring, and indicating the day of the week, the month, and the day of the month, wherein said means further includes a reset switch disposed on said top of said housing, between said digital clock and said ring and diametrically opposite to said digital calendar, wherein said reset switch of said means has RESET indicia disposed next thereto, wherein said digital clock is in electrical communication with a power source and with said reset switch which also is in electrical communication with said power source, wherein said means further includes a ring counter contained within said housing and in electrical communication with said reset switch, said power source, and a ground, wherein said ring counter has 28 counter positions thereto, each of which being associated with a respective section of said 28 equally-spaced sections of said ring, wherein said means further includes 28 relays contained within said housing, and wherein each relay of said 28 relays of said means is in electrical communication with said ground and with a respective counter position of said 28 counter positions of said ring counter and a respective bulb of said plurality of bulbs.

2. The clock as defined in claim 1, wherein said housing is thin and cylindrically-shaped.

3. The clock as defined in claim 1, wherein said power source is replaceable batteries contained within said housing.

4. The clock as defined in claim 1, wherein said plurality of bulbs includes a first set of 10 green bulbs contained within said housing; each green bulb of said first set of 10 green bulbs selectively illuminates a respective section of the first 10 sections of said 28 equally-spaced sections of said ring; each green bulb of said first set of 10 green bulbs is in electrical communication with said power source and with a respective relay of said 28 relays that are in electrical communication with the first ten counter positions of said 28 counter positions of said ring counter and with said reset switch being closed at the first day of the menstrual cycle causing said ring counter to initialize and activate the first counter position of said 28 counter positions of said ring counter which in turn closes the first relay of said 28 relays that is in electrical communication therewith which in turn causes the first green bulb of said first set of 10 green bulbs that is in electrical communication therewith to illuminate and cause the first section of said 28 equally-spaced sections of said ring to illuminate and indicate the first day of the menstrual cycle, and each time thereafter that said digital clock indicates 12:00 AM, said digital clock generates a pulse to said ring counter which causes said ring counter to activate the next subsequent counter position of said 28 counter positions of said ring counter and deactivate the next previous counter position of said 28 counter positions of said ring counter and thereby extinguish the next previous green bulb of said first set of 10 green bulbs while closing the next subsequent relay of said 28 relays that is in electrical communication therewith which in turn causes the next subsequent green bulb of said first set of 10 green bulbs that is in electrical communication therewith to illuminate and cause the next subsequent section of said 28 equally-spaced sections of said ring to illuminate and indicate consecutively the second through tenth days of the menstrual cycle with the first 10 days of the menstrual cycle utilizing green bulbs to indicate a safe time to indulge in sexual intercourse with minimal chance of pregnancy.

5. The clock as defined in claim 4, wherein said plurality of bulbs further includes 7 blinking red bulbs contained within said housing; each blinking red bulb of said 7 blinking red bulbs selectively blinks a respective section of the next 7 sections of said 28 equally-spaced sections of said ring; each blinking red bulb of said 7 blinking red bulbs is in electrical communication with said power source and with a respective relay of said 28 relays that are in electrical communication with the next 7 counter positions of said 28 counter positions of said ring counter and after the last green bulb of said first set of 10 green bulbs has been illuminated and said digital clock again indicates 12:00 AM, said digital clock again generates another pulse to said ring counter which causes said ring counter to activate the eleventh counter position of said 28 counter positions of said ring counter and deactivate the tenth counter position of said 28 counter positions of said ring counter and thereby extinguish the tenth and final green bulb of said first set of 10 green bulbs while closing the eleventh relay of said 28 relays that is in electrical communication therewith which in turn causes a first blinking red bulb of said 7 blinking red bulbs that is in electrical communication therewith to blink and cause the eleventh section of said 28 equally-spaced sections of said ring to blink and indicate the 11 day of the menstrual cycle, and each time said digital clock again indicates 12:00 AM, said digital clock again generates another pulse to said ring counter which causes said ring counter to activate the next subsequent counter position of said 28 counter positions of said ring counter and deactivate the next previous counter position of said 28 counter positions of said ring counter and thereby extinguish the next previous blinking red bulb of said 7 blinking red bulbs while closing the next subsequent relay of said 28 relays that is in electrical communication therewith which in turn causes the next subsequent blinking red bulb of said 7 blinking red bulbs that is in electrical communication therewith to blink and cause the next subsequent section of said 28 equally-spaced sections of said ring to blink and indicate consecutively the twelfth through seventeenth days of the menstrual cycle with the eleventh through seventeenth days of the menstrual cycle utilizing red bulbs to indicate an unsafe time to indulge in sexual intercourse with maximum chance of pregnancy, especially during the twelfth through sixteenth days when ovulation occurs.

6. The clock as define din claim 5, wherein said plurality of bulbs further includes a second set of 11 green bulbs contained within said housing; each green bulb of said second set of 11 green bulbs selectively illuminates a respective section of the next and final 11 sections of said 28 equally-spaced sections of said ring; each green bulb of said second set of 11 green bulbs is in electrical communication with said power source and with a respective relay of said 28 relays that are in electrical communication with the next and final 11 counter positions of said 28 counter positions of said ring counter and after the last blinking red bulb of said 7 blinking red bulbs has been illuminated and said digital clock again indicates 12:00 AM, said digital clock generates another pulse to said ring counter which causes said ring counter to activate the eighteenth counter position of said 28 counter positions of said ring counter and deactivate the seventeenth counter position of said 28 counter positions of said ring counter and thereby extinguish the seventeenth and final blinking red bulb of said 7 blinking red bulbs while closing the eighteenth relay of said 28 relays that is in electrical communication therewith which in turn causes the first green bulb of said second set of 11 green bulbs that is in electrical communication therewith to illuminate which in turn causes the eighteenth section of said 28 equally-spaced sections of said ring to illuminate and indicate the eighteenth day of the menstrual cycle, and each time said digital clock again indicates 12:00 AM, said digital clock again generates another pulse to said ring counter which causes said ring counter to activate the next subsequent counter position of said 28 counter positions of said ring counter and deactivate the next previous counter position of said 28 counter positions of said ring counter and thereby extinguish the next previous green bulb of said second set of 11 green bulbs while closing the next subsequent relay of said 28 relays that is in electrical communication therewith which in turn causes the next subsequent green bulb of said second set of 11 green bulbs that is in electrical communication therewith to illuminate and cause the next subsequent section of said 28 equally-spaced sections of said ring to illuminate and indicate consecutively the nineteenth through twenty eighth day of the menstrual cycle with the eighteenth through twenty eight days of the menstrual cycle utilizing green bulbs to indicate a safe time to indulge in sexual intercourse with minimal chance of pregnancy.

* * * * *